US007911125B2

(12) United States Patent
Kim et al.

(10) Patent No.: US 7,911,125 B2
(45) Date of Patent: Mar. 22, 2011

(54) ELECTRON EMISSION DEVICE USING ABRUPT METAL-INSULATOR TRANSITION AND DISPLAY INCLUDING THE SAME

(75) Inventors: Hyun-Tak Kim, Daejeon (KR); Byung Gyu Chae, Daejeon (KR); Kwang-Yong Kang, Daejeon (KR); Yoon Ho Song, Daejeon (KR)

(73) Assignee: Electronics and Telecommunications Research Institute, Daejeon-si (KR)

( * ) Notice: Subject to any disclaimer, the term of this patent is extended or adjusted under 35 U.S.C. 154(b) by 298 days.

(21) Appl. No.: 12/064,948

(22) PCT Filed: Aug. 25, 2006

(86) PCT No.: PCT/KR2006/003356

§ 371 (c)(1),
(2), (4) Date: Jun. 26, 2008

(87) PCT Pub. No.: WO2007/024119

PCT Pub. Date: Mar. 1, 2007

(65) Prior Publication Data

US 2008/0315775 A1 Dec. 25, 2008

(30) Foreign Application Priority Data

Aug. 26, 2005 (KR) ..... 10-2005-0078915
Feb. 25, 2006 (KR) ..... 10-2006-0018507

(51) Int. Cl.
*H01J 1/62* (2006.01)

(52) U.S. Cl. ..... 313/495; 313/311; 313/497; 315/167

(58) Field of Classification Search ..... 315/167, 315/169.4; 313/309–311, 336, 351, 495, 313/497

See application file for complete search history.

(56) References Cited

U.S. PATENT DOCUMENTS 5,654,607 A 8/1997 Yamaguchi et al.
6,121,642 A 9/2000 Newns
6,157,123 A * 12/2000 Schmid et al. ..... 313/422
6,184,619 B1 * 2/2001 Yamazaki et al. ..... 313/495

(Continued)

FOREIGN PATENT DOCUMENTS

JP 2005143283 6/2005
WO 2005041308 5/2005

OTHER PUBLICATIONS

International Search Report for PCT/KR2006/003356 dated Nov. 21, 2006.

(Continued)

*Primary Examiner* — Douglas W Owens
*Assistant Examiner* — Tung X Le
(74) *Attorney, Agent, or Firm* — Kile Park Goekjian Reed & McManus PLLC

(57) ABSTRACT

An electron emission device having a high electron emitting rate and a display including the device are provided. The electron emission device using abrupt metal-insulator transition, the device including: a board; a metal-insulator transition (MIT) material layer disposed on the board and divided by a predetermined gap with portions of the divided MIT material layer facing one another; and electrodes connected to each of the portions of the divided metal-insulator transition material layer for emitting electrons to the gap between the portions of the divided metal-insulator transition material layer.

17 Claims, 4 Drawing Sheets

U.S. PATENT DOCUMENTS

| | | | | |
|---|---|---|---|---|
| 6,495,966 | B2 * | 12/2002 | Aoki et al. | 315/169.1 |
| 2001/0040430 | A1 * | 11/2001 | Ito et al. | 313/496 |
| 2004/0245906 | A1 * | 12/2004 | Ishizuka et al. | 313/311 |
| 2005/0134161 | A1 * | 6/2005 | Kitamura et al. | 313/309 |
| 2005/0139867 | A1 | 6/2005 | Saito et al. | |
| 2005/0287689 | A1 * | 12/2005 | Iwaki et al. | 438/22 |

OTHER PUBLICATIONS

Written Opinion for PCT/KR2006/003356 dated Nov. 21, 2006.

M. I. Elinson et al., "The Emission of Hot Electrons and the Field Emission of Electrons from Tin Oxide", Radio Eng. Electron Phys., 10, 1995, pp. 1290-1296.

* cited by examiner

ELECTRON EMISSION DEVICE USING ABRUPT METAL-INSULATOR TRANSITION AND DISPLAY INCLUDING THE SAME

CROSS-REFERENCE TO RELATED PATENT APPLICATION

This application claims the benefit of Korean Patent Application No. 10-2005-0078915, filed on Aug. 26, 2005, and Korean Patent Application No. 10-2006-0018507, filed on Feb. 25, 2006, in the Korean Intellectual Property Office, the disclosures of which are incorporated herein in its entirety by reference.

BACKGROUND OF THE INVENTION

1. Field of the Invention

The present invention relates to an electron emission device and a display including the same, and more particularly, to an electron emission device using an abrupt metal-insulator transition and a display including the same.

2. Description of the Related Art

Electron emission devices have various application fields. For example, a field emission display (FED) using a principle of a cathode-ray tube (CRT) display has been researched. FEDs have many disadvantages such as oxidation of metal tip used in the FEDs that emit electrons, and complicated etching and packaging technologies. In order to overcome these disadvantages, a FED using a carbon nanotube (CNT) tip instead of a metal tip was introduced. However, FEDs with CNT tips also have shortcomings such as a difficulty in growing the carbon nanotube uniformly.

Recently, surface conduction electron emitter (SCE) displays are in the spotlight due to their ease of manufacture. FIG. 1 is a plan view of a SCE display 10 for schematically showing a principle of a SCE display. The principle of the SCE display was introduced by M. I. Elinson in Radio. Eng. Electron Phys., 10, 1995. Canon Inc. manufactured a FED using the principle of the SCE display. Major technologies for manufacturing this FED were introduced in U.S. Pat. No. 5,654,607.

Referring to FIG. 1, the SCE display 10 includes an electrode 14 divided to form a groove 16 on a board 12. That is, the electrode 14 is divided by a predetermined distance with the divided portions facing one another. Electrons are emitted from the SCE display 10 while passing through the groove 16.

However, the SCE display 10 has a low electron emitting rate, for example, 3%. Furthermore, no technology has been disclosed to overcome such a low electron emitting rate. Therefore, there is a high demand to develop an electron emission device having a high electron emitting rate.

SUMMARY OF THE INVENTION

The present invention provides an electron emission device having a high electron emitting rate.

The present invention also provides a display including an electron emission device having a high electron emitting rate.

According to an aspect of the present invention, there is prodivided an electron emission device using abrupt metal-insulator transition (MIT), the device including: a board; a metal-insulator transition (MIT) material layer disposed on the board and divided by a predetermined gap with portions of the divided MIT material layer facing one another; and electrodes connected to each of the portions of the divided metal-insulator transition material layer for emitting electrons to the gap between the portions of the divided metal-insulator transition material layer.

An emission voltage for emitting the electrons to the gap may increase if the width of the gap is widened. The gap may have a shape of a groove by uniformly separating the metal-insulator transition material layer. The gap may be formed such that each of the portions of the divided metal-insulator transition material layer has a sharp end with the sharp ends of the portions of the divided metal-insulator transition material layer separated and facing each other.

The portions of the divided metal-insulator transition material layer may be completely separated by the gap. The portions of the metal-insulator transition material layer may be connected.

According to another aspect of the present invention, there is prodivided a display including: a board; a metal-insulator transition (MIT) material layer disposed on the board and divided by a predetermined gap with the portions of the divided MIT material layer facing one another; electrodes connected to each of the portions of the divided metal-insulator transition material layer for emitting electrons to the gap between the portions of the divided metal-insulator transition material layer; and a display panel for transforming the emitted electrons so as to be visually recognizable.

The display may further include a transparent electrode between the metal-insulator transition material layer and the display panel for directing the electrons toward the display panel.

BRIEF DESCRIPTION OF THE DRAWINGS

The above and other features and advantages of the present invention will become more apparent by describing in detail exemplary embodiments thereof with reference to the attached drawings in which.

DETAILED DESCRIPTION OF THE INVENTION

Figure 1:
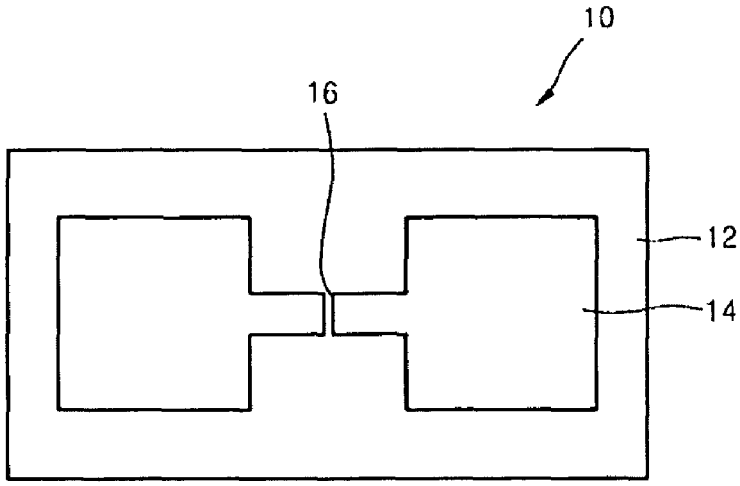
FIG. 1 (PRIOR ART)
FIG. 1 is a plan view of a conventional surface conduction electron emitter (SCE) display for schematically showing a principle of the SCE display.

The present invention will now be described more fully with reference to the accompanying drawings, in which exemplary embodiments of the invention are shown. The invention may, however, be embodied in many different forms and should not be construed as being limited to the embodiments set forth herein; rather, these embodiments are prodivided so that this disclosure will be thorough and complete, and will fully convey the concept of the invention to those skilled in the art. Like reference numerals in the drawings denote like elements, and thus descriptions thereof will be omitted.

Embodiments of the present invention relate to a surface conduction electron emission device using a metal-insulator transition (MIT) material. The surface conduction electron emission device of the present invention emits electrons created in large quantities using the abrupt metal-insulation transition (MIT), which is different from a conventional SCE display. Therefore, the surface conduction electron emission devices of the present invention provide a high electron emitting rate by emitting a large amount of electrons. In another embodiment of the present invention, the electron emission device according to the present invention is applied to a display by directions to the emitted electrons through a strong electric field.

A MIT material layer has characteristics of abrupt phase transition from an insulator to a metal by energy variation between electrons. For example, a phase transition from the insulator to the metal is abruptly induced by varying the energy between electrons by injecting holes. The MIT material layer may include at least one selected from a group consisting of an inorganic compound semiconductor with a low density of holes and an insulator including oxygen, carbon, semiconductor elements in groups III to V and II to VI, a transition metal element, a rare-earth element or a lanthanum element, an organic semiconductor with a low density of holes and an insulator, a semiconductor with a low density of holes, or an oxide semiconductor with a low density of holes and an insulator.

Figure 2:
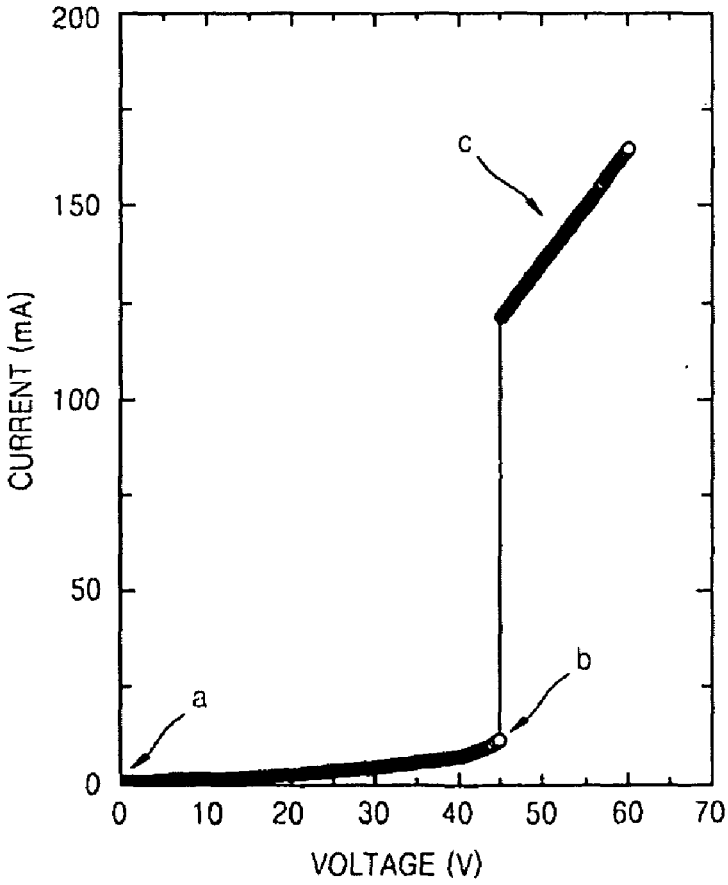
FIG. 2 is a graph showing a relationship between a current (I) and a voltage (V) of a metal-insulator transition (MIT) material layer according to an embodiment of the present invention.

FIG. 2 is a graph showing a relationship between a current (I) and a voltage (V) of a MIT material layer according to an embodiment of the present invention.

Referring to FIG. 2, the MIT material layer has a critical voltage (b) where the electric characteristic of the MIT material layer is abruptly changed from an insulator (a) to a metal (c). As shown, the critical voltage (b) of the MIT material layer used in the present embodiment is about 45V. For example, the MIT material layer has the electric characteristics of an insulator if a voltage from about 0V to 45V is supplied to both ends of the MIT material layer. However, the electric characteristic of the MIT material layer changes from those of an insulator to those of a metal (c) if a voltage higher than 45V is supplied to the MIT material layer. That is, a non-continuous jump of current occurs at about 45V. Herein, the MIT material layer contains a large amount of electrons when the MIT material layer is in the metal state (c). The critical voltage (b) may change according to a structure of elements or a type of material used in the MIT material layer.

The electron emission device according to the present embodiment includes a MIT material layer having a portion divided by a predetermined distance with the divided portions facing each other and at least one electrode at each end of the MIT material layer. Hereinafter, embodiments of the present invention will be described based on a shape of the MIT material layer.

First Embodiment

Figure 3A:
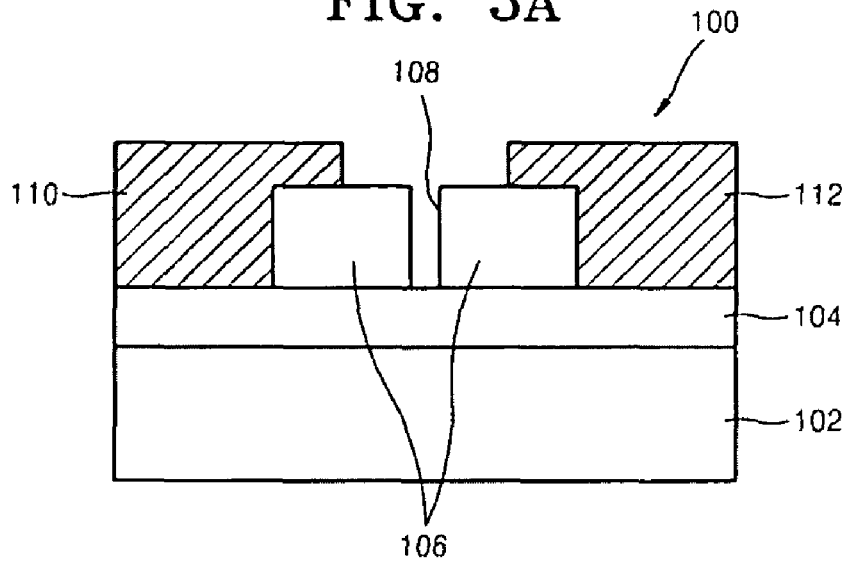
FIG. 3A is a cross-sectional view of a first two-terminal electron emission device having a horizontal structure according to a first embodiment of the present invention.
Figure 3B:
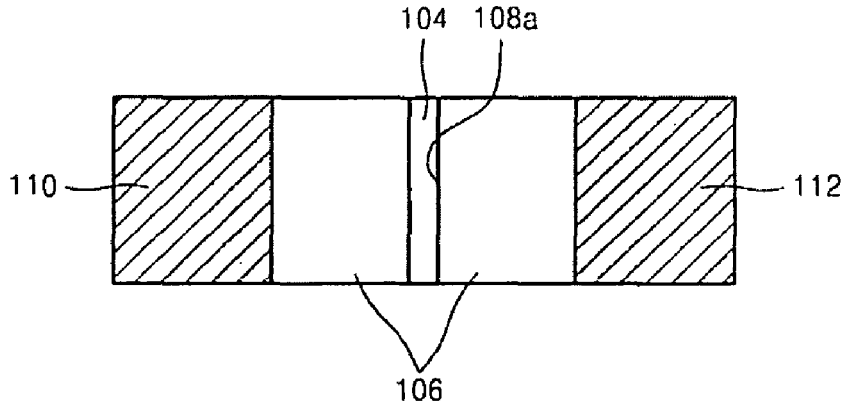
FIGS. 3B and 3C are plan views of first electron emitting devices having different shaped MIT material layers according to embodiments of the present invention.
Figure 3C:
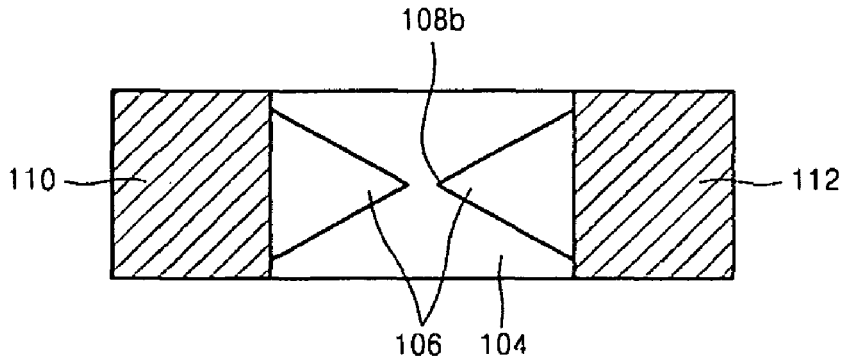

FIG. 3A is a cross-sectional view of a first two-terminal electron emission device 100 having a horizontal structure according to a first embodiment of the present invention. FIGS. 3B and 3C are plane views of the first electron emitting device 100 having different shaped MIT material layers.

Referring to FIG. 3A, a MIT material layer 106 is formed on a substrate 102. The MIT material layer 106 may be formed on a predetermined portion of a surface of the board 102. The MIT material layer 106 is divided by a first gap 108 and the divided portion of MIT material layer 106 are separated and face one another. A buffer layer 104 may be interposed between the board 102 and the MIT material layer 106. The buffer layer 104 may be formed on the entire surface of the board 102. The first gap 108 is formed by completely dividing the MIT material layer 106 to expose the top surface of the buffer layer 104. The divided portions of the MIT material layer 106 are connected to two electrodes, for example, a first electrode 110 and a second electrode 112, respectively. An electric current horizontally flows through the board 102 after the electric characteristic of the MIT material layer 106 is changed to a metal state.

Although the material used to form the board 102 is not especially limited, the board 102 may be one selected from a group consisting of an organic material layer, an inorganic material layer, at least one layer configured of a compound thereof and a patterned structure of these layers. For example, the board 102 may be formed of various materials such as a sapphire single crystal, silicon, a glass, a quartz, a compound semiconductor or a plastic. However, a reaction temperature is limited if the board 102 is formed of a glass or a plastic. The plastic may be used to form a flexible board 102. In order to form a board to have a length of about 8 inches, the board 102 is formed of the silicon, the glass and the quartz used, for example, a silicon-on-insulator (SOI).

The buffer layer 104 is interposed to improve the crystallinity of the MIT material layer 106 and to enhance the adhesive force between the board 102 and the MIT material layer 106. In order to improve the crystallinity and the adhesive force, the buffer layer 104 may be formed of crystalline thin film having a lattice constant similar to that of the MIT material layer 106. For example, the buffer layer 104 may be at least one of an aluminum oxide layer, a high dielectric layer, a crystalline metal layer and a silicon oxide layer. In the case of using an aluminum oxide layer, it must be sufficient to maintain a predetermined level of crystallinity. In case of using a silicon oxide layer, the silicon oxide layer should be formed as thin as possible. The buffer layer 104 may be formed of multiple layers including high dielectric layers having higher crystallinity such as a $TiO_2$ layer, a $ZrO_2$ layer, a $Ta_2O_5$ layer or a $HfO_2$ layer, and compounds thereof or/and the crystalline metal layer.

The two electrodes 110 and 112 may be made of any conductive materials. For example, the two electrodes 110 and 112 may be at least one layer formed of one of the group consisting of metals Li, Be, C, Na, Mg, Al, K, Ca, Sc, Ti, V, Cr, Mn, Fe, Co, Ni, Cu, Zn, Ga, Rb, Sr, Y, Zr, Nb, Mo, Tc, Ru, Rh, Pd, Ag, Cd, In, Sn, Sb, Cs, Ba, La, Hf, Ta, W, Re, Os, Ir, Pt, Au, Hg, Pb, Bi, Po, Ce, Pr, Nd, Sm, Eu, Gd, Tb, Dy, Ho, Er, Tm, Yb, Lu, Th, U, Np, Pu, a compound thereof, an oxide material including the metal and the compound. Herein, the compound of the metals may be TiN or WN and the oxide material including the metal and the compound may be ITO (In-Tin Oxide) and AZO (Al-Zinc Oxide) or ZnO.

The first gap 108 may be formed in various shapes. FIGS. 3B and 3C show examples of the first gap 108 having different shapes. However, the first gap 108 is not limited by the shapes shown in FIGS. 3B and 3C, and the first gap 108 may have various shapes without departing from the spirit and scope of the present invention. For convenience, a numeral reference 108*a* is assigned to the first gap shown in FIG. 3B, and a numeral reference 108*b* is assigned to the first gap shown in FIG. 3C.

Referring to FIG. 3B, the first gap 108*a* is formed in a shape of a groove by uniformly dividing the MIT material layer 106.

The first gap 108*a* may be formed to in order to etch the MIT material layer 106 using a conventional method. The first gap 108*a* has a shape maximizing a cross sectional area of the MIT material layer 106 which emits the electrons. The shape of the first gap 108*a* causes the MIT material layer 106 to emit electrons within a comparatively large area to the first gap 108*a*. Since the first gap 108*a* allows wide electron emission, it may be advantageously applied to the first electron emission device 100 according to the first embodiment of the present invention.

Referring to FIG. 3C, the first gap 108*b* divides the MIT material layer 106 so that each of the divided portions of the MIT material layer 106 has a sharp end. The sharp ends of the divided portions of the MIT material layer 106 are separated by a predetermined distance to face one another. The shape of the first gap 108*b* minimizes a cross sectional area of the MIT material layer 106 that emits the electrons. The MIT material layer 106 emits electrons within a comparatively narrow range to the first gap 108*b*. Also, the first gap 108*b* structurally increases the electron emission rate compared to the first gap 108*a* shown in FIG. 3B. Since the first gap 108*b* emits electrons within a narrow range, it may be advantageously applied to the first electron emission device 100 according to the first embodiment of the present invention.

Figure 4:
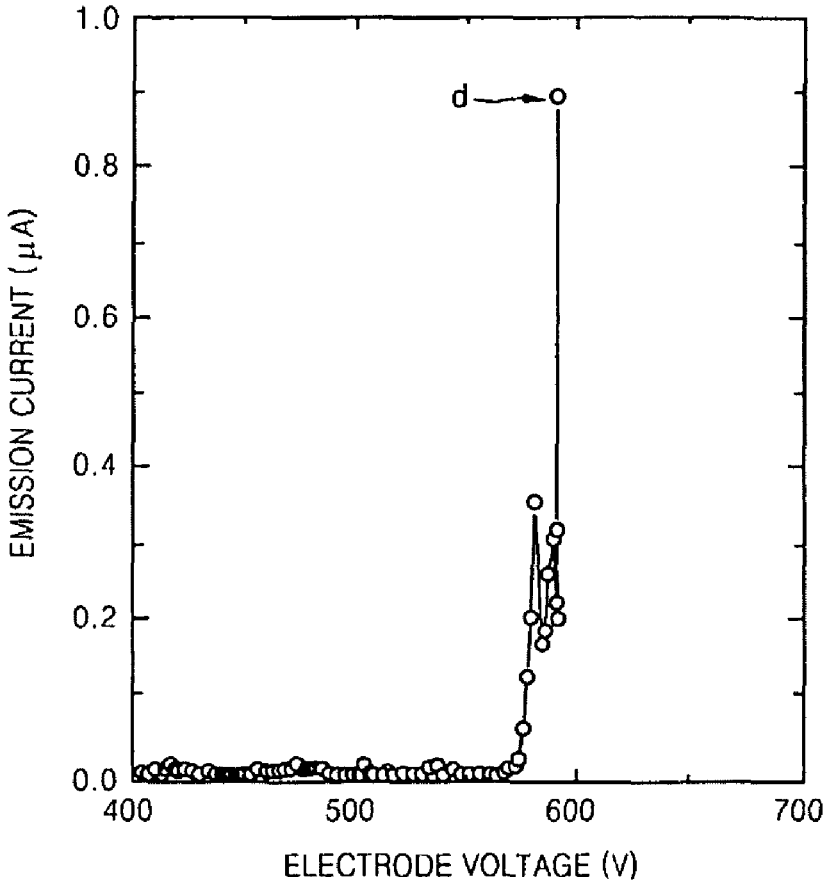
FIG. 4 is a graph showing an emission current of electrons emitted by using the first electron emission device of FIG. 3A.

FIG. 4 is a showing an emission current of electrons emitted by using the first electron emission device 100. In this case, the first electron emission device 100 has the first gap 108*b* shown in FIG. 3C to increase the electron emission rate. In more detail, the first electron emission device 100 includes the MIT material layer 106 made of $VO_2$ and the two electrodes 110 and 112, each made of laminated Cr and Cu. The width of the first gap 108*b* is about 100 nm and a pattern length of each of the divided portions of the MIT material layer 106 is about 500 nm.

Referring to FIG. 4, if a voltage is applied to the two electrodes 110 and 112, the first electron emission device 100 abruptly emits electrons at about 580V. Herein, a voltage that causes abruptly electron emission for the device 100 is defined as an emission voltage. The abrupt electron emission means that the state of the MIT material layer 106 is changed from an insulator to a metal before abruptly emitting the electrons. As shown in FIG. 2, the transition of the MIT material layer 106 from the insulator to the metal occurs at the critical voltage (b) which is lower than the emission voltage. Therefore, if the applied voltage reaches the level of the emission voltage, electrons in the MIT material layer 106 in the metal state are emitted to the first gap 108*b*.

Meanwhile, the emission voltage may be controlled according to a width of the first gap 108*b*, the shape of the MIT material layer 106 and the type of the MIT material layer 106. For example, it is possible to lower the emission voltage by reducing the width of the first gap 108*b*. It is preferable that the width of the first gap 108*b* is about 5 to 200 nm. The first electron emission device 100 according to the first embodiment of the present invention may generate a large amount of electrons compared to the conventional electron emission device by using the metal-insulator transition. Because the material changes to the metal state through the abrupt metal-insulator transition, it holds a large amount of current. Since the first electron emission device 100 according to the first embodiment of the present invention is described to explain the principle of emitting electrons using metal-insulator transition, the emission voltage may be controlled at various values.

Second Embodiment

Figure 5:
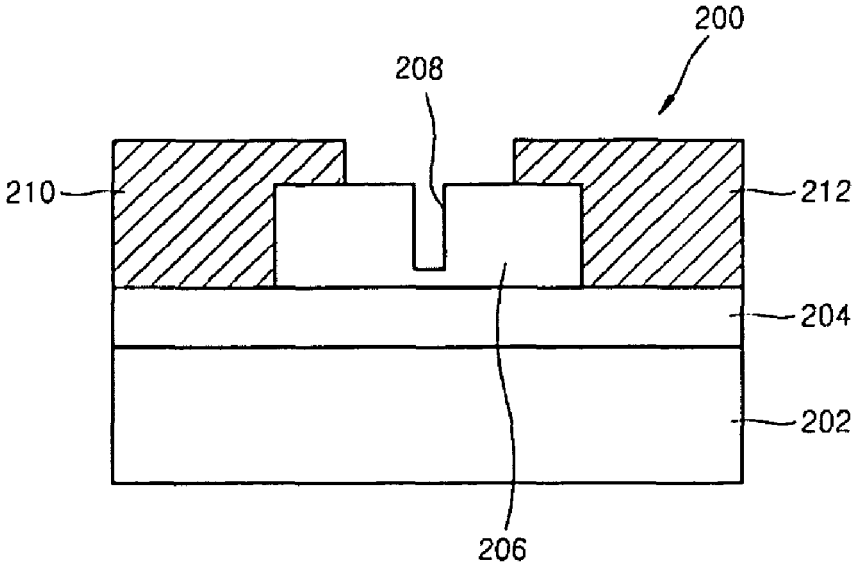
FIG. 5 is a cross-sectional view of a second two-terminal electron emission device having a horizontal structure according to a second embodiment of the present invention.

FIG. 5 is a cross-sectional view of a second electron emission device 200 having a horizontal structure according to a second embodiment of the present invention.

Referring to FIG. 5, a MIT material layer 206 is formed on a board 202. The MIT material layer 206 may be formed on a predetermined portion of a surface of the board 202. The MIT material layer 206 is divided by a second gap 208 with the divided portions of the MIT material layer 206 facing one another. A buffer layer 204 may be interposed between the board 202 and the MIT material layer 206. The buffer layer 204 may be formed on the entire surface of the board 202. The second gap 208 according to the second embodiment of the present invention is formed to remove a predetermined portion of the MIT material layer 206. The potions of divided MIT material layers 206 are contacted to two electrodes, for example, a first electrode 210 and a second electrode 212, respectively.

Operations of the second electron emission device 200 are identical to those of the first electron emission device 100 described with reference to FIGS. 3A through 4. Apart from the way that the second gap 208 is formed by partially removing a portion of the MIT material layer 206, the structure and the method of manufacturing the second electron emission device 200 are identical to those of the first electron emission device 100. That is, the second electron emission device 200 is an electron emission device having a different shape according to another embodiment of the present invention. That is, the electron emission device of the present invention is not limited by the first and the second electron emission devices 120 and 200 and may be changed without departing from the spirit and scope of the present invention.

Display Using Electron Emission Device

Figure 6:
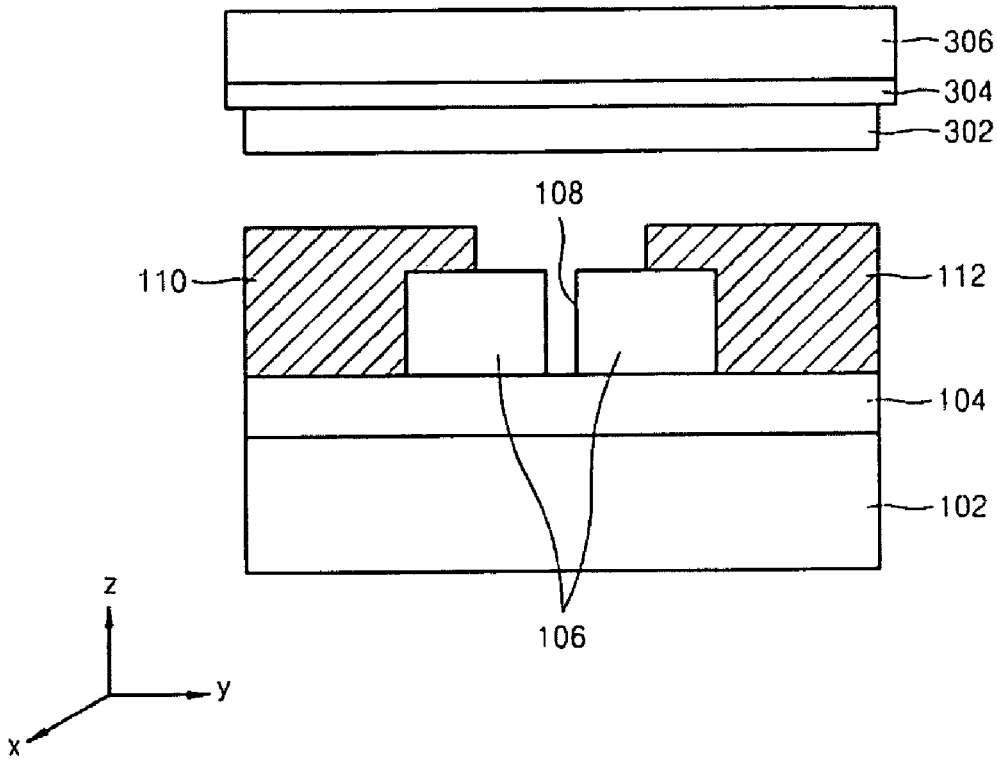
FIG. 6 shows a display including an electron emitting device according to an embodiment of the present invention.

FIG. 6 illustrates a display including an electron emitting device according to an embodiment of the present invention. The display illustrated in FIG. 6 includes the first electron emission device 100.

Referring to FIG. 6, the first electron emission device 100 includes a display panel 306 for transforming the emitted electron so as to be visually recognizable. The display panel 306 can be embodied as, for example, a fluorescent screen. A transparent electrode 304 formed of ITO, for example, and an anode electrode 302 may be sequentially adhered to the display panel 306. The electrons emitted from the first electron emission device 100 move in a direction of a Z axis due to an electric field created from the transparent electrode 304 and collide against the display panel 306. As a result, the display panel emits light.

As described above, the electron emission device according to the present invention provides a high electron emission rate by emitting electrons to a gap between divided portions of a MIT material layer using abrupt metal-insulator transition.

Also, the electron emission device according to the present invention may be used to embody a display having a high electron emission rate.

While the present invention has been particularly shown and described with reference to exemplary embodiments thereof, it will be understood by those of ordinary skill in the art that various changes in form and details may be made therein without departing from the spirit and scope of the present invention as defined by the following claims.

What is claimed is:

1. An electron emission device using abrupt metal-insulator transition (MIT), the device comprising:

a board;

a metal-insulator transition (MIT) material layer disposed on the board and divided by a predetermined gap with portions of the divided MIT material layer facing one another; and electrodes connected to each of the portions of the divided metal-insulator transition material layer for emitting electrons to the gap between the portions of the divided metal-insulator transition material layer.

2. The electron emission device of claim 1, wherein the board is formed of one selected from the group consisting of an organic material layer, an inorganic material layer, at least one of a plurality of layers formed of a compound thereof and a patterned structure thereof.

3. The electron emission device of claim 1, wherein the width of the gap is in a range of about 5 to 200 nm.

4. The electron emission device of claim 1, wherein the gap has a shape of a groove uniformly separating the metal-insulator transition material layer.

5. The electron emission device of claim 1, wherein the gap is formed such that each of the portions of the divided metal-insulator transition material layer has a sharp end with the sharp ends of the portions of the divided metal-insulator transition material layer separated and facing each other.

6. The electron emission device of claim 1, wherein the portions of the divided metal-insulator transition material layer are completely separated by the gap.

7. The electron emission device of claim 1, wherein the portions of the metal-insulator transition material layer are connected.

8. The electron emission device of claim 1, wherein the metal-insulator transition material comprises at least one selected from the group consisting of an inorganic compound semiconductor with a low density of holes and an insulator including oxygen, carbon, semiconductor elements in groups III to V and II to VI, a transition metal element, a rare-earth element or a lanthanum element, an organic semiconductor with a low density of holes and an insulator, a semiconductor with a low density of holes, or an oxide semiconductor with a low density of holes and an insulator.

9. The electron emission device of claim 1, wherein the electrodes constitutes at least one layer made of metals comprising Li, Be, C, Na, Mg, Al, K, Ca, Sc, Ti, V, Cr, Mn, Fe, Co, Ni, Cu, Zn, Ga, Rb, Sr, Y, Zr, Nb, Mo, Tc, Ru, Rh, Pd, Ag, Cd, In, Sn, Sb, Cs, Ba, La, Hf, Ta, W, Re, Os, Ir, Pt, Au, Hg, Pb, Bi, Po, Ce, Pr, Nd, Sm, Eu, Gd, Tb, Dy, Ho, Er, Tm, Yb, Lu, Th, U, Np, Pu, a compound thereof, an oxide material comprising the metal and the compound thereof.

10. A display comprising:

a board;

a metal-insulator transition (MIT) material layer disposed on the board and divided by a predetermined gap with the portions of the divided MIT material layer facing one another;

electrodes connected to each of the portions of the divided metal-insulator transition material layer for emitting electrons to the gap between the portions of the divided metal-insulator transition material layer; and a display panel for transforming the emitted electrons so as to be visually recognizable.

11. The display of claim 10, wherein the gap has a shape of a groove by uniformly separating the metal-insulator transition material layer.

12. The display of claim 10, wherein the gap is formed such that each of the portions of the divided metal-insulator transition material layer has a sharp end with the sharp ends of the portions of the divided metal-insulator transition material layer separated and facing each other.

13. The display of claim 10, wherein the portions of the divided metal-insulator transition materials are completely separated by the gap.

14. The display of claim 13, further comprising a transparent electrode between the metal-insulator transition material layer and the display panel for directing the electrons toward the display panel.

15. The display of claim 10, wherein the portions of the divided metal-insulator transition material are connected.

16. The display of claim 10, wherein the width of the gap is in a range of about 5 to 200 nm.

17. An electron emission device using abrupt metal-insulator transition (MIT), the device comprising:

a board;

a metal-insulator transition (MIT) material layer disposed on the board and divided by a predetermined gap with portions of the divided MIT material layer facing one another, the metal-insulator transition material layer having an electric characteristic which is abruptly changed from an insulator to a metal at a predetermined critical voltage; and electrodes connected to each of the portions of the divided metal-insulator transition material layer for emitting electrons to the gap between the portions of the divided metal-insulator transition material layer.

* * * * *